US006588631B2

(12) United States Patent
Sanchez

(10) Patent No.: US 6,588,631 B2
(45) Date of Patent: Jul. 8, 2003

(54) SYSTEM FOR DISPENSING A PRODUCT

(75) Inventor: Marcel Sanchez, Aulnay-sous-Bois (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/059,165

(22) Filed: Jan. 31, 2002

(65) Prior Publication Data

US 2002/0117518 A1 Aug. 29, 2002

(30) Foreign Application Priority Data

Jan. 31, 2001 (FR) ..... 01 01312

(51) Int. Cl.[7] ..... B65D 83/00
(52) U.S. Cl. ..... 222/402.13; 222/402.23
(58) Field of Search ..... 222/402.13, 402.21–402.23, 222/402.25, 182

(56) References Cited

U.S. PATENT DOCUMENTS 3,233,788 A 2/1966 Diamond ..... 222/182
3,583,607 A 6/1971 Beck ..... 222/402.21
3,739,941 A * 6/1973 Ostrwosky et al. .... 222/153.11
5,305,930 A * 4/1994 De Laforcade ..... 222/402.13
5,915,599 A * 6/1999 Takahashi ..... 222/402.13
5,971,226 A * 10/1999 Goncalves ..... 222/321.6

FOREIGN PATENT DOCUMENTS

WO WO 95/03234 2/1995

* cited by examiner

*Primary Examiner*—Joseph A. Kaufman
(74) *Attorney, Agent, or Firm*—Finnegan, Henderson, Farabow, Garrett & Dunner, LLP

(57) ABSTRACT

The present invention relates to a system for dispensing a product. The system may include a receptacle containing the product, a tilt-type valve on the receptacle, and a dispensing head for actuating the tilt-type valve and dispensing the product. The dispensing head may include at least one orifice for dispensing the product. The dispensing head and the tilt-type valve may be configured such that actuation of the tilt-type valve may be achieved only by applying a force on the tilt-type valve in a direction lateral to the tilt-type valve.

38 Claims, 4 Drawing Sheets

SYSTEM FOR DISPENSING A PRODUCT

BACKGROUND OF THE INVENTION

The present invention relates to a system for dispensing a product, for example, a cosmetic product such as a care product, a body-hygiene product, a hair-care product, a make-up product, and/or a sunscreen product. The product could optionally be, for example, in the form of a spray, a foam, a mousse, a gel, or a cream.

In the field of aerosol packaging, two general types of valve are known. The first type is a so-called push-in valve whose actuation may result from a force exerted exclusively on an actuation surface along an axis of the valve. The second type is a so-called tilt-type valve whose actuation may result from a force exerted laterally (i.e., transversely) to the axis of the tilt-type valve or a force exerted axially (i.e., along the axis of the tilt-type valve). The choice of the valve type may depend on the location to which the product is to be applied. An exemplary tilt-type valve is described in International Publication No. WO 95/03234.

One of the possible advantages of tilt-type valves may lie in the fact that, by virtue of their configuration, actuation may be generated in response to both a lateral force and an axial force. This characteristic may enable the use of such a device in numerous actuation positions.

This actuation characteristic of tilt-type valves, however, could, in certain applications, be a disadvantage due at least in part to the strong tendency of certain products to clog or to oxidize on contact with air. For example, in some applications, it may be desirable to close off the dispensing orifice as hermetically as possible. To this end, it may be desirable to use a cap whose inner surface includes a member (e.g., a spike) which when on the dispenser, bears against the edges delimiting the dispensing orifice in a substantially leaktight manner. In such a configuration, the placing of the cap on the dispenser may generate an accidental actuation of the valve by means of an inadvertent axial pushing-in of the valve, resulting in an unintended dispensing of the product. The product could possibly soil the dispensing head, which may interfere with the intended use of the device.

In the above-mentioned WO 95/03234 reference, the risk of accidental actuation may be somewhat reduced (although not fully eliminated) by arranging the dispensing orifice at an end of a passage located in a recess delimited by the dispensing head, with the axial position of the orifice being below the axial position of an upper opening delimited by an edge of the recess. This configuration, however, may fail to solve the accidental actuation problem encountered when the product is of a type requiring a highly leaktight closure of the outlet orifice, for example. In fact, a cap equipped with a stud capable of engaging with the outlet orifice of the valve rod may generate accidental actuation of the valve rod by transmitting an axial force on the valve when the cap is placed on the dispenser.

Moreover, such a device may be unsatisfactory for dispensing a product in the form of, for example, a cream, a foam, or a gel. These products may have a high viscosity such that they cannot be sprayed. Such products may need to be transferred onto a finger of the user when they exit the dispensing orifice. Transferring product onto a finger, however, may be difficult to accomplish when the dispensing orifice is inside a recess.

A similar accidental actuation problem may arise in the device described in U.S. Pat. No. 3,583,607. In this reference, the dispensing orifice emerges laterally and is on a piece slipped over the valve rod. The piece delimits an actuation zone in the form of a tongue, which may be capable of causing product to exit in response to a force exerted both laterally and axially.

SUMMARY

An optional feature of the invention is to provide a system of the aerosol can-type that may use a tilt-type valve and which substantially reduces the risk of accidental actuation when replacing a protective cap. Optionally, the system may address one or more disadvantages of conventional devices.

Another optional feature of the invention is to provide a system that is economical to produce and that is simple and reliable to use.

Yet another optional feature of the invention is to provide a system that uses a tilt-type valve and may be used with products in the form of a cream, a gel, and/or a foam.

Yet another optional feature of the invention is to provide a device that can be used with products that may deteriorate on contact with the air.

In accordance with the purpose of the invention, as embodied and broadly described herein, the invention includes a system for dispensing a product. The system may include a receptacle for containing a product, a tilt-type valve provided on the receptacle, and a dispensing head for actuating the tilt-type valve and dispensing the product. The dispensing head may include a passage selectively in flow communication with the receptacle through the tilt-type valve, and at least one orifice at one end of the passage. The at least one orifice may be axially fixed.

According to another optional aspect, the dispensing head for actuating the tilt-type valve may include at least one orifice for dispensing the product. The dispensing head and tilt-type valve may be configured such that actuation of the tilt-type valve may be achieved only by applying a force on the tilt-type valve in a direction lateral to the tilt-type valve.

In yet another optional aspect, the dispensing head may include a passage selectively in flow communication with the receptacle through the tilt-type valve, and at least one orifice at an end of the passage. The dispensing head and tilt-type valve may be configured such that the end of the passage having the at least one orifice remains substantially stationary when the tilt-type valve is actuated.

According to still another optional aspect, the dispensing head may include a passage selectively in flow communication with the receptacle through the tilt-type valve, at least one orifice at an end of the passage, and an actuation surface. The dispensing head and tilt-type valve may be configured so that an axial force applied to the actuation surface does not actuate the tilt-type valve.

A force exerted laterally on the tilt-type valve is a force exerted in a direction that is not parallel to the axis of the valve or the axis of the valve rod with which such a tilt-type valve is equipped. For example, a lateral force may be a force in a direction substantially perpendicular to the axis of the tilt-type valve or the axis of the valve rod. Thus, unlike conventional devices that may be equipped with a tilt-type valve that can be actuated both by axial pushing-in and by lateral tilting, the valve of the system according to the present invention optionally may be actuated only by lateral tilting.

In other words, according to one optional aspect of the invention, the configuration of the dispensing head and the tilt-type valve may be selected such that actuation of the valve by axially pushing in the valve cannot take place. Only a force exerted transversely to the valve rod may be able to actuate the tilt-type valve.

Thus, when the system includes a cap having a part intended for engaging in a substantially leaktight manner with the dispensing orifice, the risks of accidental actuation of the tilt-type valve when replacing the cap may be substantially reduced.

Similarly when the product (e.g., in the form of a gel, a foam, or a cream) is to be taken directly from the dispensing orifice, such as with a finger or the hand, the risks of generating an undesired actuation of the tilt-type valve when the product is being taken may also be substantially reduced.

In another optional aspect, the dispensing head may include means for fastening the dispensing head onto the receptacle. For example, the means may include snap-fitting the dispensing head on the receptacle, the use of adhesive bonding, and/or the use of threads to fasten the dispensing head onto the receptacle. The dispensing orifice may emerge in a portion of the dispensing head fixed axially relative to the receptacle.

An additional optional aspect may include a system wherein the receptacle defines an axis, and wherein the at least one orifice is located substantially along the axis of the receptacle. Alternatively, the at least one orifice may be located outside of the axis (i.e., not substantially along the axis). In this latter case, the dispensing orifice may be oriented, for example, in a direction inclined relative to the axis. The choice of one configuration or another may depend on the product to be applied and/or on the application surface.

Yet another optional aspect of the invention may include a system wherein the dispensing head may include at least one actuation surface for actuating the tilt-type valve. The at least one actuation surface may be configured to flex about a zone of the dispensing head located substantially adjacent to the at least one orifice. The zone may alternatively be located on a portion of the dispensing head substantially opposite from the at least one orifice.

In still another aspect, the dispensing head may be provided with two or more actuation surfaces. These actuation surfaces may be distributed in a substantially equidistant manner along a periphery of the dispensing head. Such actuation surfaces may be delimited at least partially by a cutout formed, for example, when molding the dispensing head. Optionally, the actuation surface(s) may be molded initially in a position corresponding to an operating position. The dispensing head may consist of a single piece.

According to another optional aspect, the dispensing head may further include a coupling element. The coupling element may couple the at least one actuation surface to a portion of the dispensing head.

In yet another optional aspect, when the dispensing head includes the passage, the passage may include a channel emerging at the orifice. The channel may be defined by the portion of the dispensing head that includes the zone about which the at least one actuation surface flexes. This portion of the dispensing head may be optionally configured to engage the tilt-type valve, for example, by force-fitting.

According to another optional aspect, when the dispensing head does not include the passage, the dispensing head may include a channel emerging at the orifice. The channel may be defined by the portion of the dispensing head that includes the zone about which the at least one actuation surface flexes.

In another optional aspect, the at least one actuation surface may be configured to move from a first position (e.g., molding position) in which the coupling element is remote from the portion of the dispensing head that includes the flex zone and the channel, to a second position (e.g., operating position) in which the coupling element is configured to engage with the portion of the dispensing head that includes the flex zone and the channel and to actuate the tilt-type valve in response to a force exerted laterally on the at least one actuation surface.

In an aspect, the at least one actuation surface may be molded in a position other than that corresponding to the operating position. The moving of the at least one actuation surface from one position to the other may include, for example, pivoting about an axis (e.g., film hinge) perpendicular to the axis of the valve.

According to another optional aspect of the invention, the system may include a cap for removably covering the dispensing head. The cap may include a member configured to provide a substantially leaktight closure of the orifice. Such a cap may be mounted removably on the system, for example, by threading onto the dispensing head or receptacle, by snap-fitting, by grip-mounting, or other appropriate method. Such a cap may optionally include a member, such as a stud, a boss, a skirt, or a spike, for example, capable of being applied in a substantially leaktight manner against the at least one orifice of the dispensing head. This member may be produced of the same material forming the cap or a different material. In the latter case, the cap may be obtained by dual injection. For example, the seal may be formed of an elastomeric material, and the remainder of the cap may be formed of a rigid or semi-rigid material, such as polypropylene or polyethylene.

In yet another optional aspect of the system, the product may be pressurized. The product may include a cosmetic product, for example, a hair-care product, a body-hygiene product, a make-up product, a care product, and/or a sunscreen product.

The optional systems described herein may be useful for preparing a cosmetic composition, for example, a hair composition, with a first product being an oxidizing agent and a second product being a dye.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate optional embodiments of the invention and, together with the description, serve to explain some principles of the invention. In the drawings.

DESCRIPTION OF EMBODIMENTS

Figure 1B:
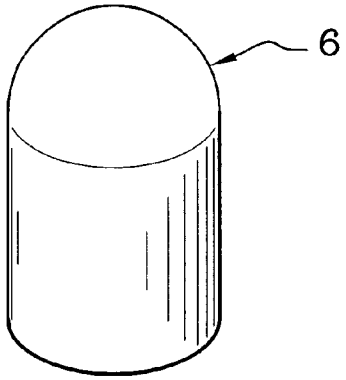
FIG. 1B is a partial perspective sectional view of an optional embodiment of a cap.
Figure 1B:
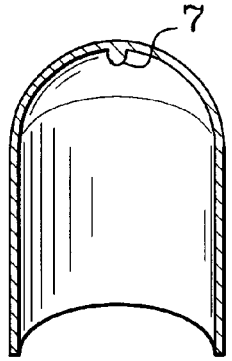

Reference will now be made in detail to optional embodiments of the invention, examples of which are illustrated in the accompanying drawings. Wherever possible, the same reference numbers are used in the drawings and the description to refer to the same or like parts.

Figure 1A:
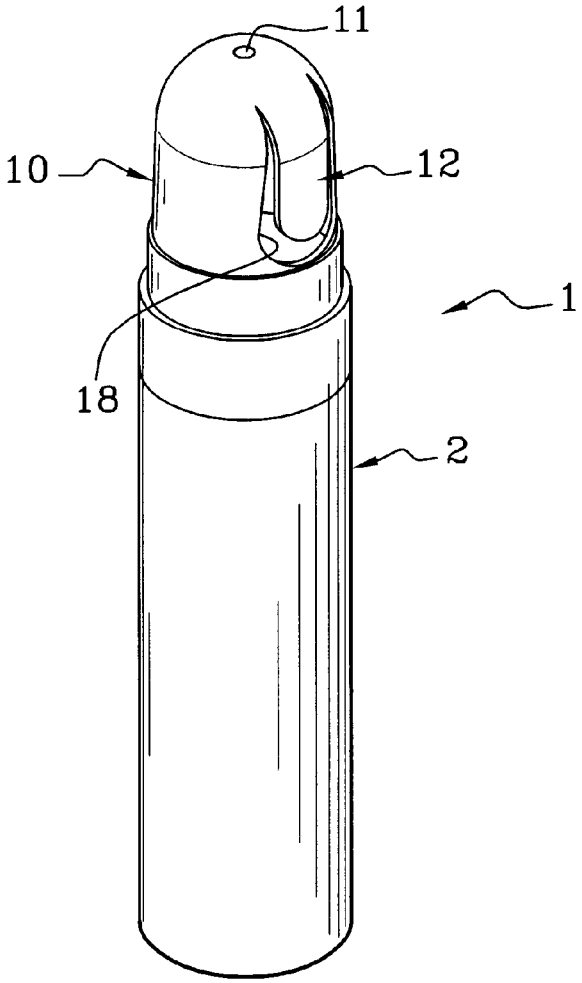
FIG. 1A is a perspective view of an optional embodiment of a system for dispensing a product.
Figure 2A:
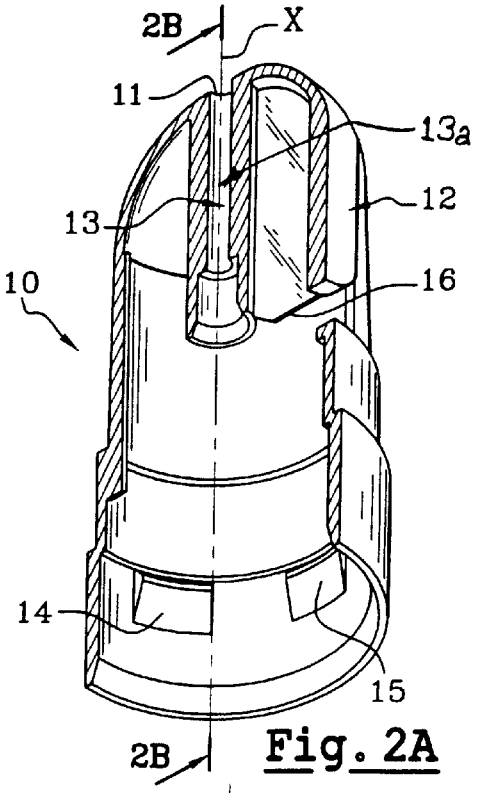
FIG. 2A is a partial perspective sectional view of an optional embodiment of a dispensing head according to one aspect of the invention.
Figure 2B:
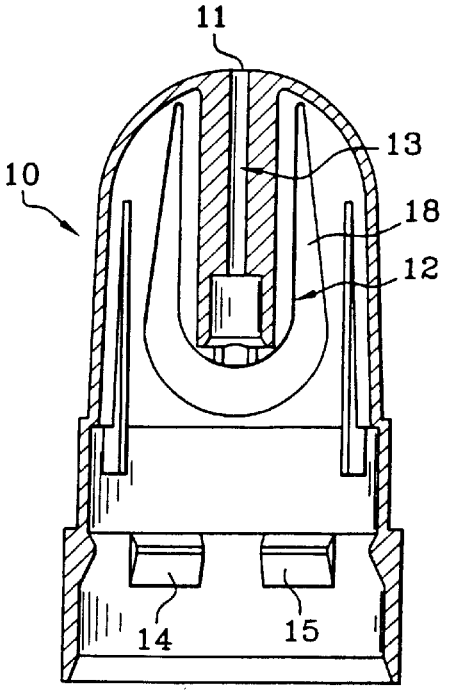
FIG. 2B is a cross-sectional view of the embodiment shown in FIG. 2A.

The system 1 shown in the form of an overall view in FIG. 1A may comprise a receptacle 2 having an optional cylindrical shape, for example, made from aluminum or tinplate. The receptacle 2 may be coupled with a dispensing head 10 for actuating a tilt-type valve with which the receptacle 2 may be equipped and for dispensing product via an outlet orifice 11 located along axis X of the system 1 (see, e.g., FIG. 2A). Actuation of the tilt-type valve may be achieved via at least one actuation surface 12, at least a part of which may optionally be arranged laterally on the dispensing head 10 (i.e., substantially parallel to the axis X). The actuation surface 12 may be shaped, for example, in the form of a tongue capable of flexing about a zone formed in the vicinity of (i.e., adjacent to) the dispensing orifice 11. The actuation surface 12 may be delimited partially by an opening 18 in a lateral wall of the dispensing head 10 and may optionally be U-shaped.

The system 1 may include a removable cap 6 intended to be placed on the dispensing head 10 in a lightly gripping manner, for example, so as to protect the dispensing head 10 from the surroundings when the system 1 is being stored. As shown in FIG. 1B, the cap may include axial boss 7 optionally formed in the bottom of cap 6. When the cap 6 is on the dispensing head 10, the axial boss 7 may be applied in a substantially leaktight manner against the outlet orifice 11 to close the outlet orifice 11.

The dispensing head 10 and cap 6 may be formed by molding thermoplastic materials such as polyethylenes or polypropylenes, for example. When the system 1 includes a product, the product may be a hair-styling gel or mousse, or a care cream, for example. Inside the receptacle 2, the product may be pressurized by a propellant gas in a compressed or liquefied form. Optionally, the product may be isolated from the propellant by means of a piston or flexible pouch.

FIGS. 2A–2D illustrate different sectional views of an exemplary system shown in a more general manner in FIGS. 1A and 1B.

The dispensing head 10 maybe generally cylindrical in shape, for example, and may comprise a closed first end optionally configured in the form of a dome. The dispensing head 10 may include a passage 13*a* which comprises an axial channel 13. At the top of the dome, along the axis X of the system, an outlet orifice 11 may emerge. The outlet orifice 11 may be formed at one end of the axial channel 13. The other end of the axial channel 13 may be configured such that it can be slipped, in a gripping manner, onto a valve rod 3. The channel 13 may extend over approximately half the axial height of the dispensing head 10. The other end of the dispensing head 10 may be open and may comprise, on its inner surface, means for fastening, for example, a plurality of beadings 14, 15 intended for mounting the dispensing head 10 on the receptacle 2 by means of snap-fitting.

Over substantially its entire height, the axial channel 13 may be integral with the first edge of a coupling portion 16. The other edge of the coupling portion 16 may be integral with an actuation surface 12 formed in the lateral wall of the dispensing head 10 and may be capable of flexing about a zone located substantially at the top of the dome, for example, in the vicinity of the dispensing orifice 11. The flexing zone may include a portion of the dispensing head 10 where the actuation surface 12 is connected to the remainder of the dispensing head 10. This flexing zone may be centered on an axis substantially perpendicular to the axis X of the system 1.

Figure 2C:
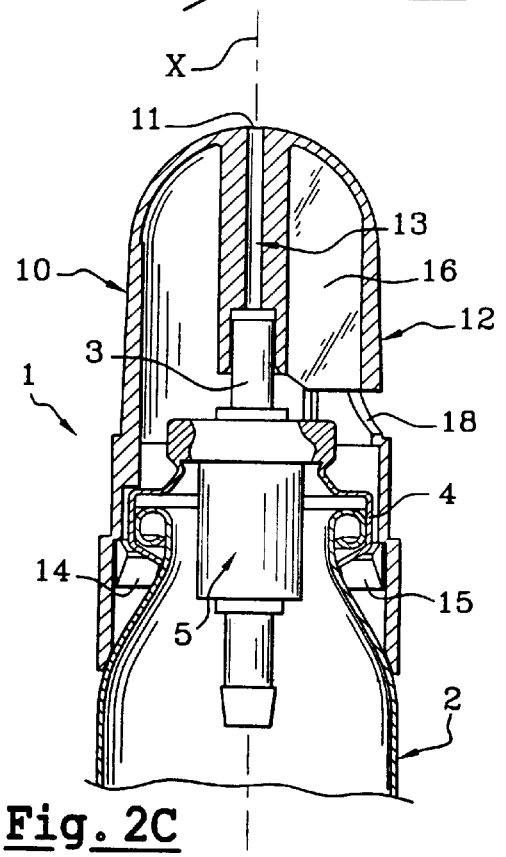
FIGS. 2C and 2D are views showing operation of an optional embodiment of a system for dispensing a product.

As shown in FIG. 2C, when the dispensing head 10 is on the receptacle 2, the beadings 14, 15 may optionally snap-fit onto the crimping beading 4 of the valve 5 to facilitate axial immobilization of the dispensing head 10 on the receptacle 2. The dispensing orifice 11 may be thereby fixed axially relative to the receptacle 2.

Figure 2D:
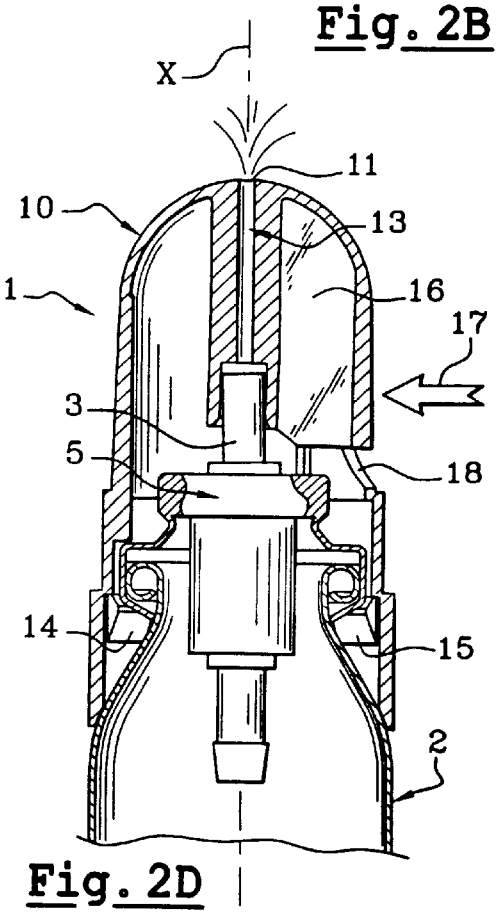

In order to use the system 1, the user may exert a lateral force on the actuation surface 12 (i.e., substantially perpendicular to the axis X) in the manner illustrated by arrow 17 in FIG. 2D. This lateral force may be transmitted to the axial portion of the dispensing head 10 in which the channel 13 is provided via the coupling portion 16. The lateral force may cause rod 3 to tilt slightly to the extent that it generates opening of the valve 5 and dispensing of the product through the outlet orifice 11. In an embodiment, tilting the valve rod 3 by an angle of a few degrees may be sufficient to generate opening of the valve 5. Conversely, any force exerted on a part of the dispensing head 10 other than on the actuating surface 12, for example, on the domed portion of the dispensing head 10, may not actuate the valve 5. Risks of accidental actuation of the valve 5, for example, when replacing the cap 6, may be thereby substantially reduced.

According to this embodiment, the dispensing head 10 may be obtained by molding, for example, with the actuation surface 12 being molded in the position it occupies during operation of the system 1. The configuration of the opening 18, which may be substantially in the form of a U, may partially delimit the actuation surface 12. The configuration of the opening 18 may be chosen such that demolding may be achieved easily while still providing an attractive appearance compatible with the market for which the system 1 is intended.

The optional embodiment shown in FIGS. 3A–3D differs from the preceding embodiment in that the actuating surface 12 may be articulated about an axis (e.g., an axis defined by a film hinge 19) located in the vicinity of (e.g., adjacent to) the open end of the dispensing head 10. For reasons of molding/demolding, the actuation surface 12 may be molded in a position different from the operating position of system 1. One optional molding position is shown by the broken lines in FIG. 3A. Passage from the molding position to the operating position may be achieved by pivoting the actuating surface 12 through approximately 90 degrees about the axis defined by the film hinge 19. Locking (e.g., by snap-fitting) may be provided in order to lock the actuating surface 12 in its operating position.

Figure 3A:
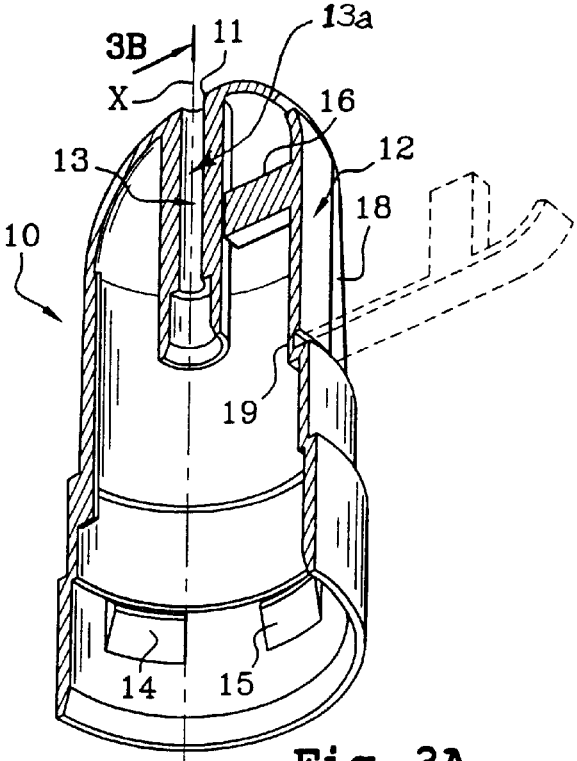
FIG. 3A is a perspective sectional view of another optional embodiment of a dispensing head.
Figure 3B:
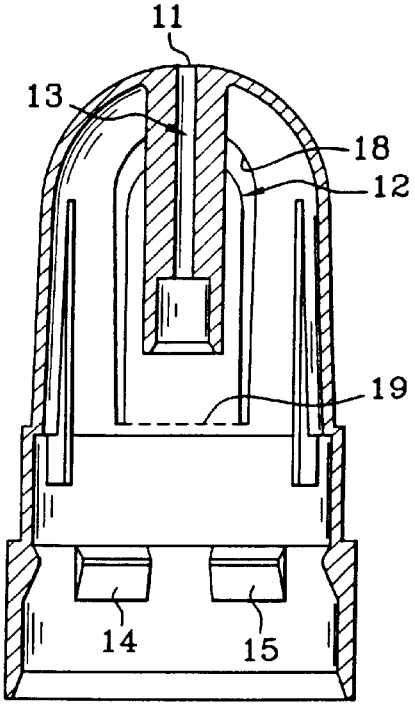
FIG. 3B is a cross-sectional view of the embodiment shown in FIG. 3A.
Figure 3C:
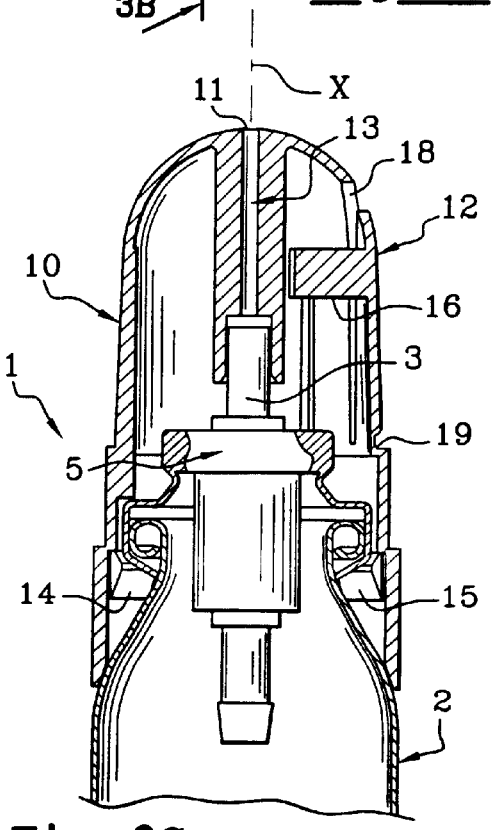
FIGS. 3C and 3D are views showing operation of another optional embodiment of a system for dispensing a product.
Figure 3D:
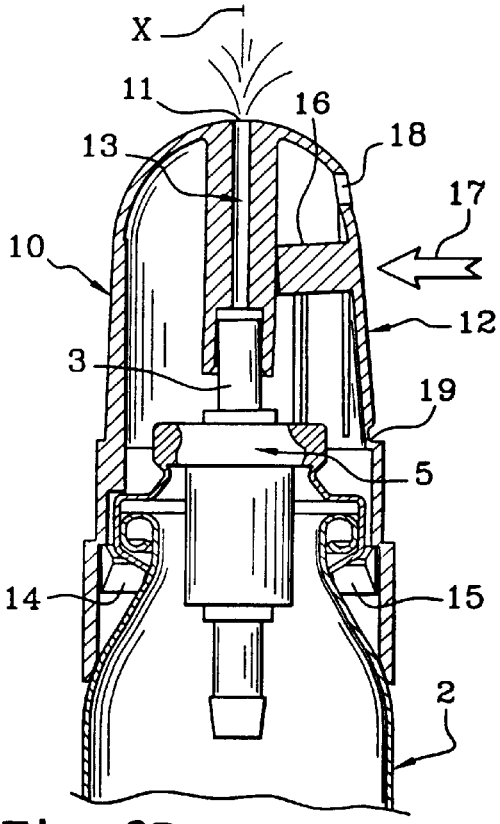

To actuate the valve 5, a force may be applied laterally with respect to the axis X, as shown by arrow 17 in FIG. 3D, to tilt the valve rod 3 and open the valve 5. A free end of the coupling portion 16 (connected to the actuation surface 12) may engage with the axial portion of the dispensing head 10 in which the channel 13 is provided to facilitate tilting of the valve rod 3. During actuation, the actuating surface 12 may tilt about an axis defined by the film hinge 19.

The operation of the embodiments of FIGS. 3A–3D is similar to that of the embodiment of FIGS. 2A–2D. As in the case of the embodiment of FIGS. 2A–2D, the actuation of the valve 5 by axial pushing-in of the valve rod 3 is rendered substantially impossible.

Figure 4A:
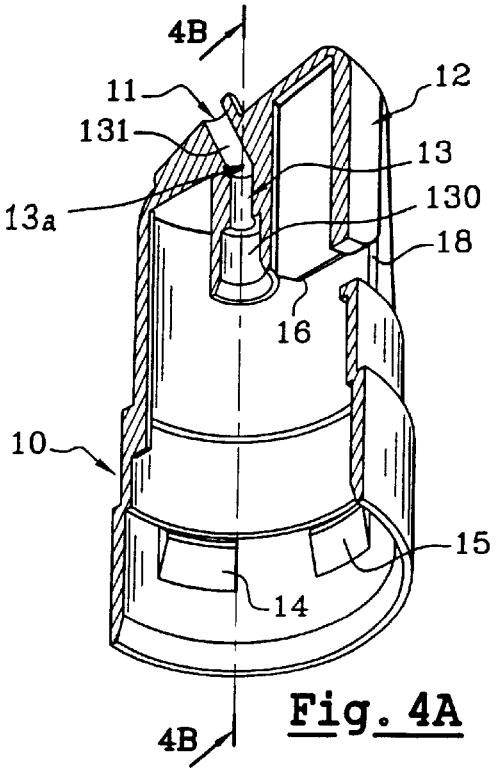
FIG. 4A is a perspective sectional view of yet another optional embodiment of a dispensing head.
Figure 4B:
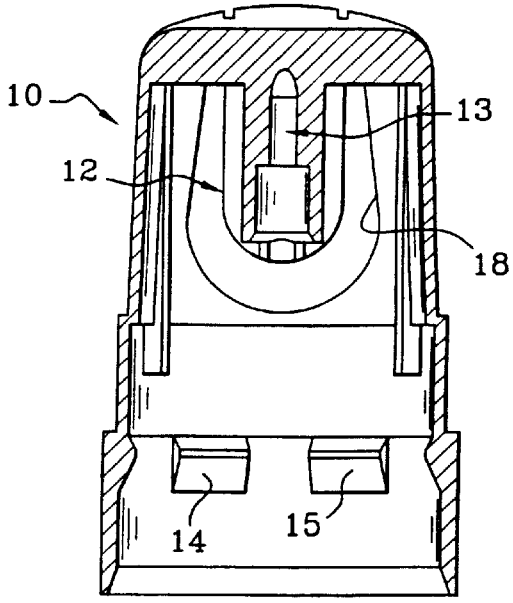
FIG. 4B is a cross-sectional view of the embodiment shown in FIG. 4A.
Figure 4C:
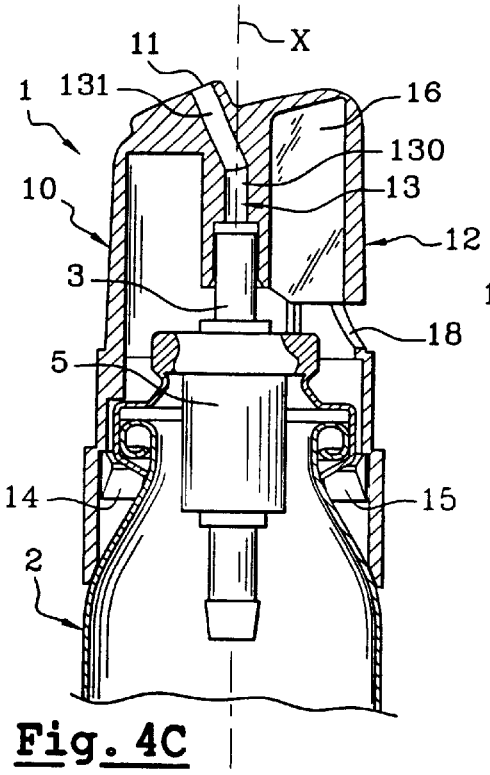
FIGS. 4C and 4D are views showing operation of yet another optional embodiment of a system for dispensing a product.
Figure 4D:
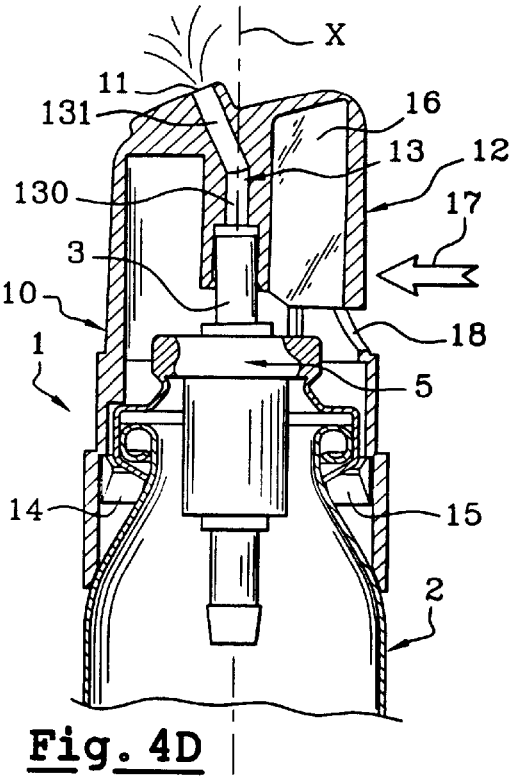

The embodiment illustrated in FIGS. 4A–4D may differ from the embodiment in FIGS. 2A–2D in that the channel 13 may comprise an axial part 130, which may be slipped onto the valve rod 3, and a part 131, which may be inclined relative to the axis X. The part 131 may couple the dispensing orifice 11, such that the dispensing of product (as shown in FIG. 4D) takes place in an inclined manner relative to the axis X. As in the case of the other embodiments, a force exerted on the dispensing head 10, other than on the actuating surface 12 (e.g., along the axis of the system 1) may have substantially no effect on the actuation of the valve 5. Thus, actuation of the valve 5 by pushing-in is rendered substantially impossible.

The system according to the optional aspects of the invention may contain any make-up or care products, such as cosmetic, dermatological, or pharmaceutical compositions used for treating hair, skin, lips, or nails. However, in its broadest aspects, the present invention could be used to contain many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A system for dispensing a product, the system comprising:

a receptacle for containing a product;

a tilt-type valve provided on the receptacle; and a dispensing head for actuating the tilt-type valve and dispensing the product, the dispensing head comprising a passage selectively in flow communication with the receptacle through said tilt-type valve, and at least one orifice at one end of the passage, the at least one orifice being axially fixed.

2. The system of claim 1, wherein the dispensing head further comprises means for fastening the dispensing head onto the receptacle.

3. The system of claim 2, wherein the means for fastening comprises a means for snap-fitting the dispensing head on the receptacle.

4. The system of claim 1, wherein the at least one orifice is located on a portion of the dispensing head that is fixed axially relative to the receptacle.

5. The system of claim 1, wherein the receptacle defines an axis, said at least one orifice being located substantially along the axis of the receptacle.

6. The system of claim 1, wherein the receptacle defines an axis, said at least one orifice being located outside of the axis.

7. The system of claim 1, wherein the dispensing head further comprises at least one actuation surface for actuating the tilt-type valve, the at least one actuation surface being configured to flex about a zone of the dispensing head, said zone being located substantially adjacent to the at least one orifice.

8. The system of claim 1, wherein the dispensing head further comprises at least one actuation surface for actuating the tilt-type valve, the at least one actuation surface being configured to flex about a zone of the dispensing head, said zone being located on a portion of the dispensing head substantially opposite from the at least one orifice.

9. The system of claim 8, wherein the dispensing head further comprises a coupling element, the coupling element coupling the at least one actuation surface to a portion of the dispensing head.

10. The system of claim 9, wherein the passage comprises a channel emerging at the orifice, the channel being defined by the portion of the dispensing head, and wherein the portion of the dispensing head is configured to engage the tilt-type valve.

11. The system of claim 10, wherein the portion of the dispensing head is configured to engage the tilt-type valve via force-fitting.

12. The system of claim 9, wherein the passage comprises a channel emerging at the orifice, the channel being defined by the portion of the dispensing head, and wherein the at least one actuation surface is configured to move from a first position in which the coupling element is remote from the portion of the dispensing head, to a second position in which the coupling element is configured to engage with the portion of the dispensing head and to actuate the tilt-type valve in response to a force exerted laterally on the actuation surface.

13. The system of claim 1, further comprising a cap for removably covering the dispensing head.

14. The system of claim 13, wherein the cap comprises a member configured to provide a substantially leaktight closure of the orifice.

15. The system of claim 1, wherein the receptacle contains a product.

16. The system of claim 15, wherein the product is pressurized.

17. The system of claim 16, wherein the pressurized product comprises a cosmetic product.

18. The system of claim 17, wherein the cosmetic product comprises at least one of a hair-care product, a body-hygiene product, a make-up product, a care product, and a sunscreen product.

19. A system for dispensing a product, the system comprising:

a receptacle for containing a product;

a tilt-type valve provided on the receptacle;

a dispensing head for actuating the tilt-type valve, the dispensing head comprising at least one orifice for dispensing the product, wherein the dispensing head and the tilt-type valve are configured such that actuation of the tilt-type valve is achieved only by applying a force on the tilt-type valve in a direction lateral to the tilt-type valve.

20. The system of claim 19, wherein the dispensing head further comprises means for fastening the dispensing head onto the receptacle.

21. The system of claim 20, wherein the means for fastening comprises a means for snap-fitting the dispensing head on the receptacle.

22. The system of claim 19, wherein the at least one orifice is located on a portion of the dispensing head that is fixed axially relative to the receptacle.

23. The system of claim 19, wherein the receptacle defines an axis, said orifice being located substantially along the axis of the receptacle.

24. The system of claim 19, wherein the receptacle defines an axis, said at least one orifice being located outside of the axis.

25. The system of claim 19, wherein the dispensing head further comprises at least one actuation surface for actuating the tilt-type valve, the at least one actuation surface being configured to flex about a zone of the dispensing head, said zone being located substantially adjacent to the at least one orifice.

26. The system of claim 19, wherein the dispensing head further comprises at least one actuation surface for actuating the tilt-type valve, the at least one actuation surface being configured to flex about a zone of the dispensing head, said zone being located on a portion of the dispensing head substantially opposite from the at least one orifice.

27. The system of claim 26, wherein the dispensing head further comprises a coupling element, the coupling element coupling the at least one actuation surface to a portion of the dispensing head.

28. The system of claim 27, wherein dispensing head further comprises a channel emerging at the orifice, the channel being defined by the portion of the dispensing head, and wherein the portion of the dispensing head is configured to engage the tilt-type valve.

29. The system of claim 28, wherein the portion of the dispensing head is configured to engage the tilt-type valve via force-fitting.

30. The system of claim 27, wherein the dispensing head further comprises a channel emerging at the orifice, the channel being defined by the portion of the dispensing head, and wherein the at least one actuation surface is configured to move from a first position in which the coupling element is remote from the portion of the dispensing head, to a second position in which the coupling element is configured to engage with the portion of the dispensing head and to actuate the tilt-type valve in response to a force exerted laterally on the actuation surface.

31. The system of claim 19, further comprising a cap for removably covering the dispensing head.

32. The system of claim 31, wherein the cap comprises a member configured to provide a substantially leaktight closure of the orifice.

33. The system of claim 19, wherein the receptacle contains a product.

34. The system of claim 33, wherein the product is pressurized.

35. The system of claim 34, wherein the pressurized product comprises a cosmetic product.

36. The system of claim 35, wherein the cosmetic product comprises at least one of a hair-care product, a body-hygiene product, a make-up product, a care product, and a sunscreen product.

37. A system for dispensing a product, the system comprising:

a receptacle for containing a product;

a tilt-type valve provided on the receptacle; and a dispensing head for actuating the tilt-type valve and dispensing the product, the dispensing head comprising a passage selectively in flow communication with the receptacle through said tilt-type valve, and at least one orifice at an end of the passage, wherein the dispensing head and tilt-type valve are configured such that the end of the passage having the at least one orifice remains substantially stationary when the tilt-type valve is actuated.

38. A system for dispensing a product, the system comprising:

a receptacle for containing a product;

a tilt-type valve provided on the receptacle; and a dispensing head for actuating the tilt-type valve and dispensing the product, the dispensing head comprising a passage selectively in flow communication with the receptacle through said tilt-type valve, at least one orifice at an end of the passage, and an actuation surface, wherein the dispensing head and tilt-type valve are configured so that an axial force applied to the actuation surface does not actuate the tilt-type valve.

* * * * *